US011612792B2

(12) United States Patent
Marshall

(10) Patent No.: US 11,612,792 B2
(45) Date of Patent: Mar. 28, 2023

(54) PICKLEBALL PADDLE ASSEMBLY

(71) Applicant: Paul Marshall, Tehachapi, CA (US)

(72) Inventor: Paul Marshall, Tehachapi, CA (US)

( * ) Notice: Subject to any disclaimer, the term of this patent is extended or adjusted under 35 U.S.C. 154(b) by 305 days.

(21) Appl. No.: 17/028,371

(22) Filed: Sep. 22, 2020

(65) Prior Publication Data

US 2022/0088449 A1 Mar. 24, 2022

(51) Int. Cl.
*A63B 59/42* (2015.01)
*A63B 60/06* (2015.01)
*A63B 102/08* (2015.01)

(52) U.S. Cl.
CPC ..... *A63B 59/42* (2015.10); *A63B 60/06* (2015.10); *A63B 2102/08* (2015.10)

(58) Field of Classification Search
CPC ..... A63B 59/42; A63B 49/022
See application file for complete search history.

(56) References Cited

U.S. PATENT DOCUMENTS 4,353,550 A * 10/1982 Krosnick ..... A63B 59/80 473/527
4,685,675 A * 8/1987 Heiman ..... A63B 60/02 473/519
4,697,811 A 10/1987 Muroi
4,984,792 A 1/1991 Pacanski
5,074,554 A * 12/1991 Ramon, Jr. ..... A63B 60/20 473/525
5,649,699 A 7/1997 Todoroff
6,062,993 A 5/2000 Rodriguez
D448,436 S 9/2001 Kuncz
7,918,752 B2 4/2011 McClung, III
8,007,379 B1 8/2011 Cook
2005/0181895 A1* 8/2005 Popovich ..... A63B 60/34 473/527
2014/0335979 A1* 11/2014 Grimes ..... A63B 49/022 473/522
2015/0283438 A1 10/2015 Hwang

FOREIGN PATENT DOCUMENTS

WO WO2013173387 11/2013

* cited by examiner

*Primary Examiner* — Eugene L Kim
*Assistant Examiner* — Christopher Glenn

(57) ABSTRACT

A pickleball paddle assembly a head having a front side, a back side and a perimeter edge. The perimeter edge includes a top edge, a bottom edge, a first lateral edge and a second lateral edge. A central portion of each of the front and back sides is planar. A handle is attached to and extends downwardly from the from the bottom edge of the head. A plurality of inserts is provided and the perimeter edge has a plurality of wells extending therein that are each configured to releasably receive and retain one of the inserts. Each insert of the plurality of inserts defines a weight such that a weight of the head is selectively altered by inserting one or more of the inserts into one or more of the wells.

18 Claims, 10 Drawing Sheets

PICKLEBALL PADDLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to game paddle device and more particularly pertains to a new game paddle device for playing pickleball and which provides a user of the game paddle the ability to alter the weight characteristics of the paddle.

(2) Description of Related Art Including Information Disclosed Under 37 CFR 1.97 and 1.98

The prior art relates to game paddle devices that are used for playing various sports having the object of hitting a ball with a paddle and which typically include static configurations and have little to no customization possibilities to better suit a player's needs.

BRIEF SUMMARY OF THE INVENTION

An embodiment of the disclosure meets the needs presented above by generally comprising a head having a front side, a back side and a perimeter edge. The perimeter edge includes a top edge, a bottom edge, a first lateral edge and a second lateral edge. A central portion of each of the front and back sides is planar. A handle is attached to and extends downwardly from the from the bottom edge of the head. A plurality of inserts is provided and the perimeter edge has a plurality of wells extending therein that are each configured to releasably receive and retain one of the inserts. Each insert of the plurality of inserts defines a weight such that a weight of the head is selectively altered by inserting one or more of the inserts into one or more of the wells.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
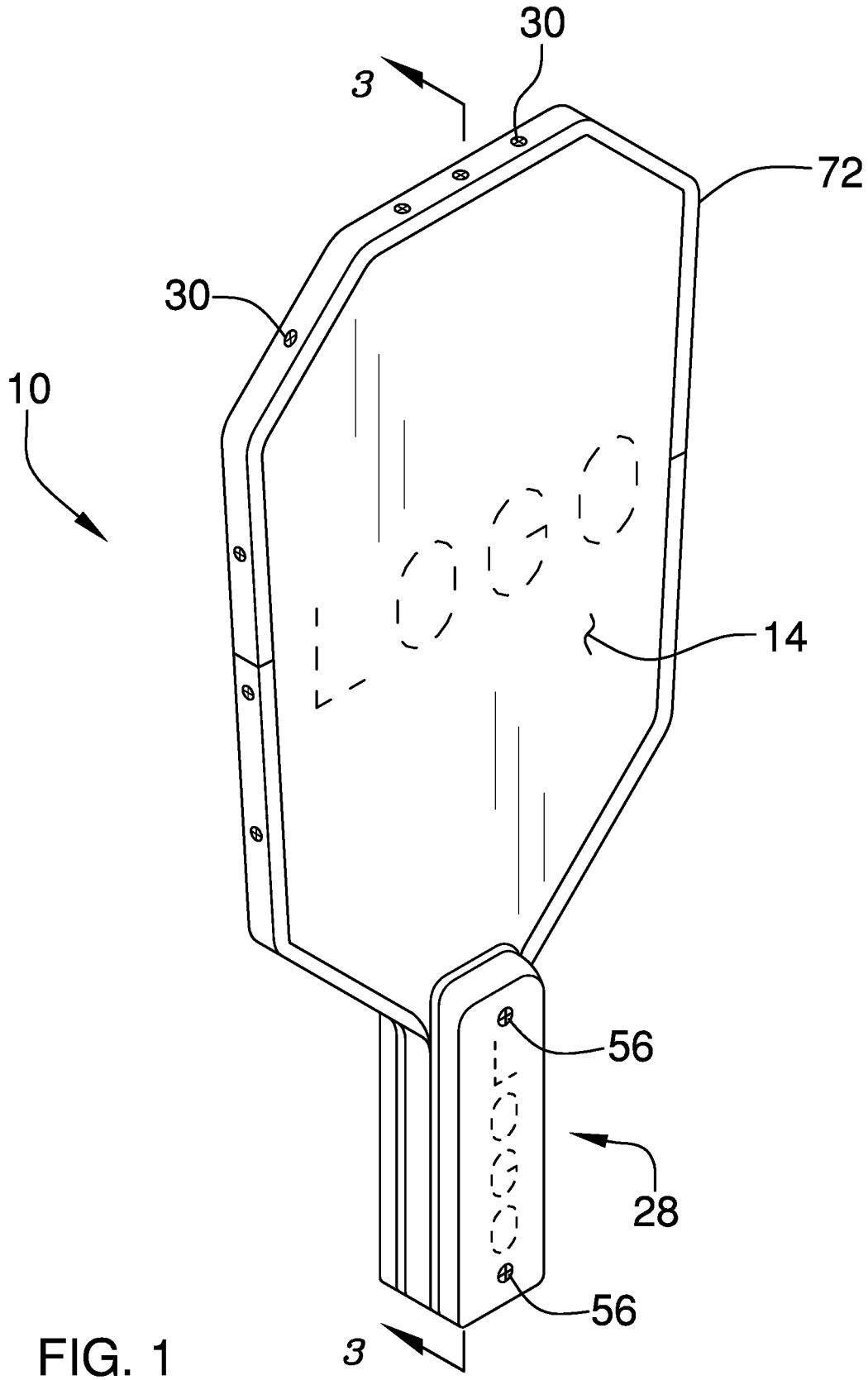
FIG. 1 is a front isometric view of a pickleball paddle assembly according to an embodiment of the disclosure.
Figure 2:
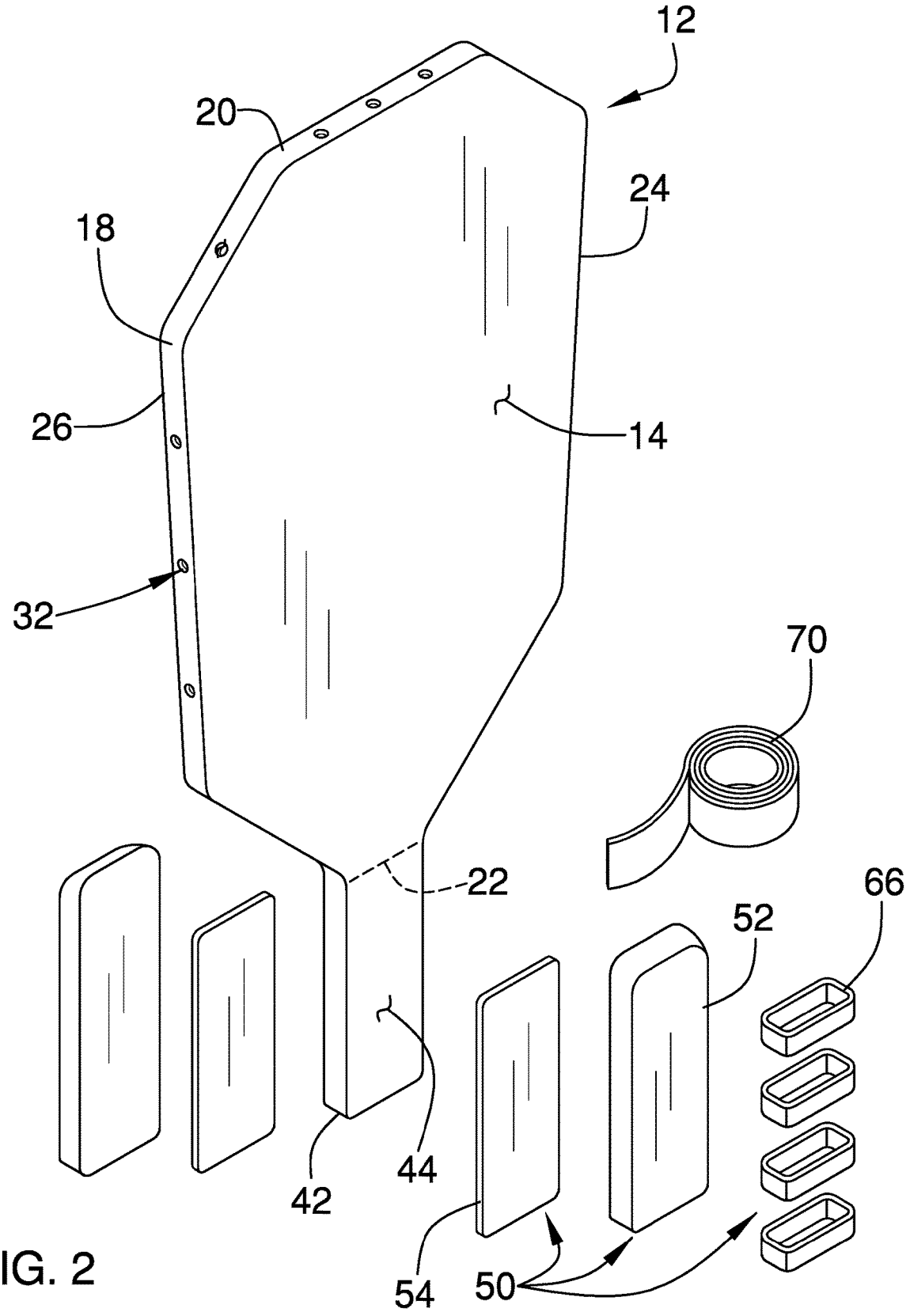
FIG. 2 is a front exploded isometric view of an embodiment of the disclosure.
Figure 3:
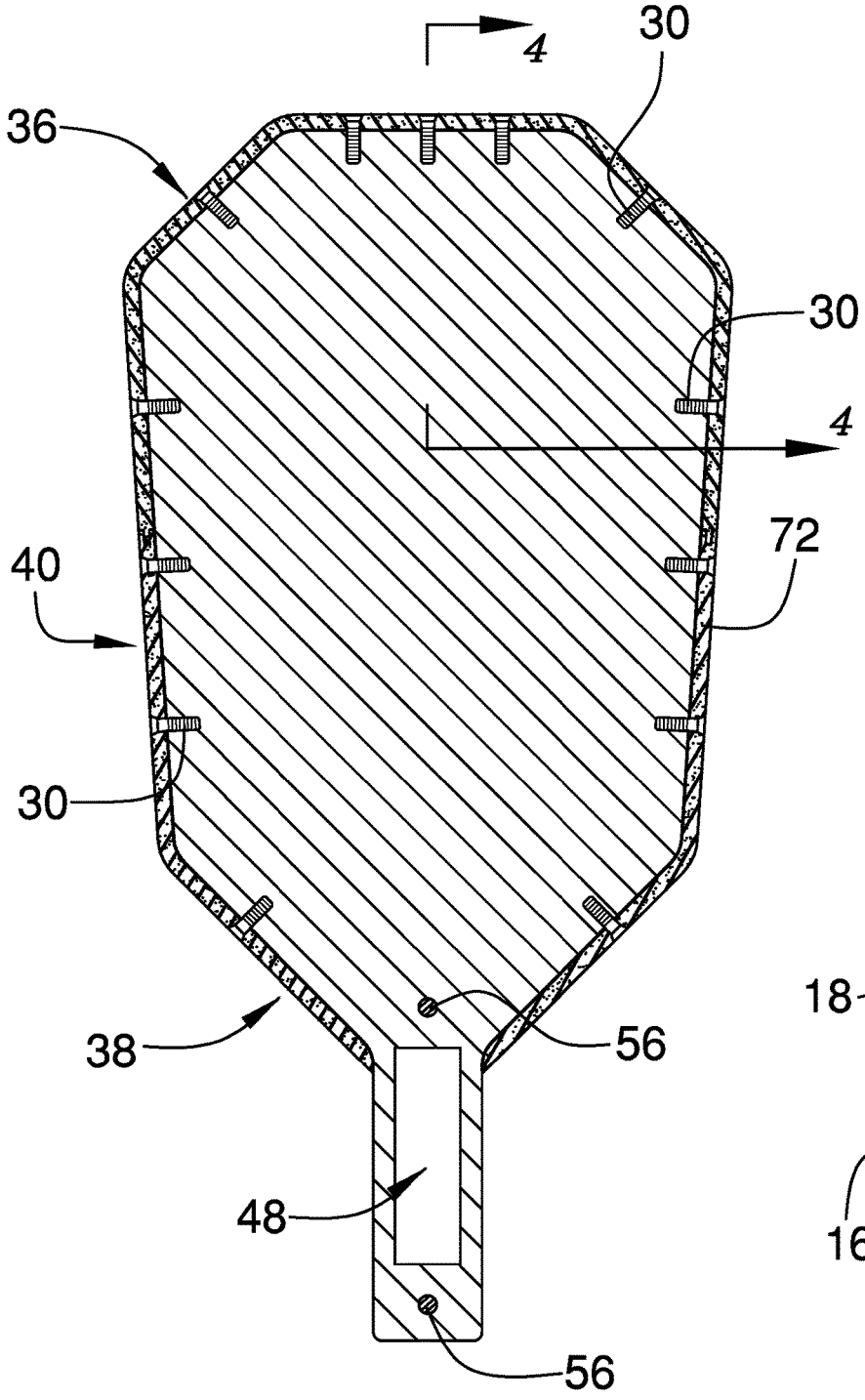
FIG. 3 is a cross-sectional view of an embodiment of the disclosure taken along line 3-3 of FIG. 1.
Figure 4:
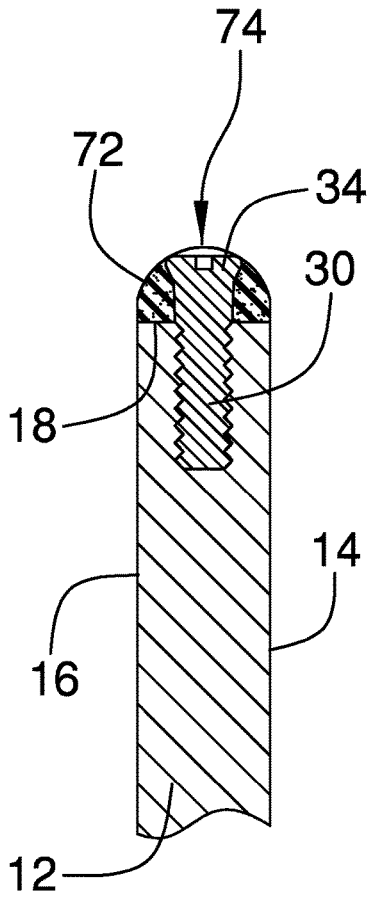
FIG. 4 is a cross-sectional view of an embodiment of the disclosure taken along line 4-4 of FIG. 3.
Figure 5:
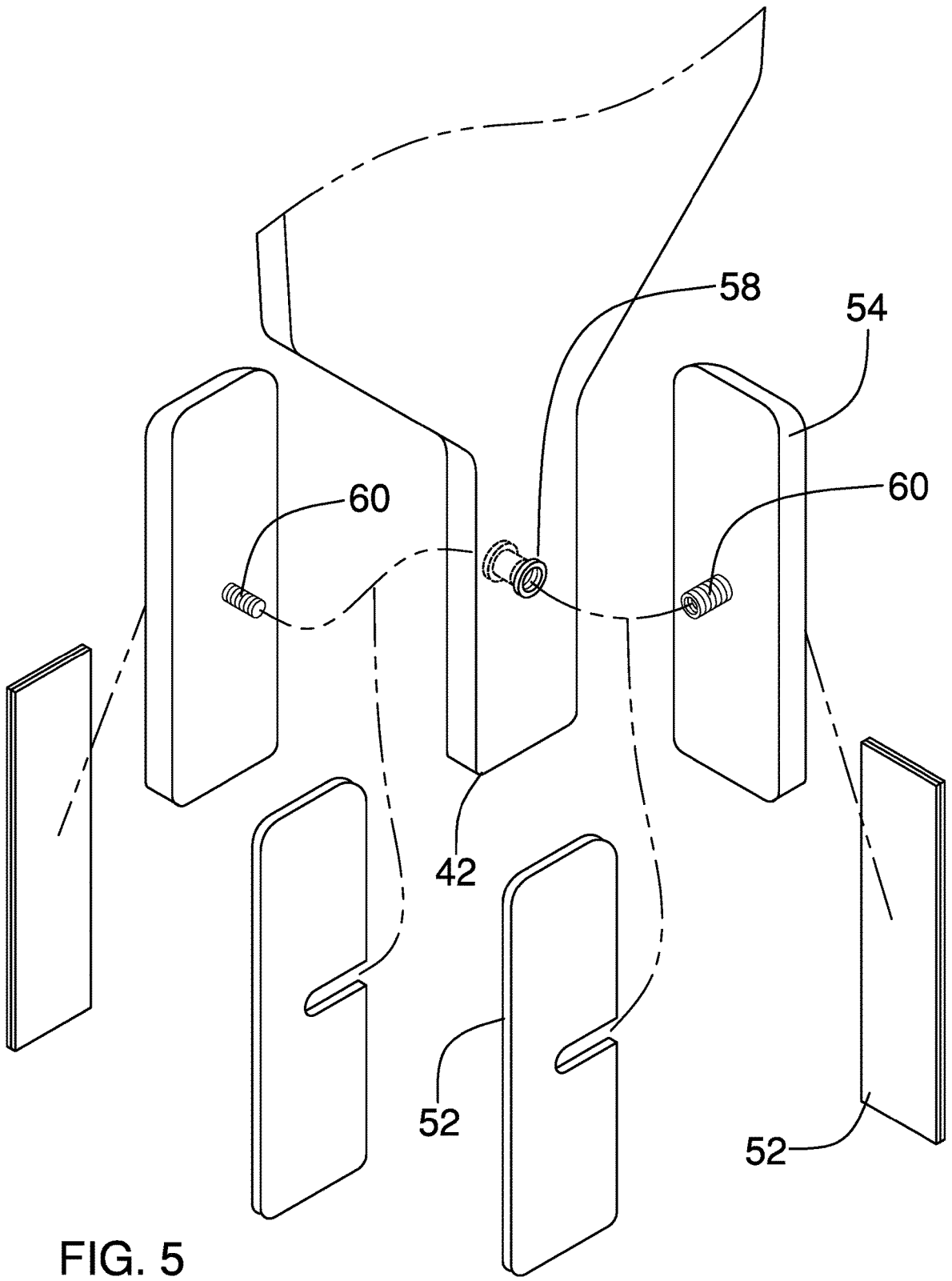
FIG. 5 is a rear isometric exploded view of an embodiment of the disclosure.

With reference now to the drawings, and in particular to FIGS. 1 through 11 thereof, a new game paddle device embodying the principles and concepts of an embodiment of the disclosure and generally designated by the reference numeral 10 will be described.

As best illustrated in FIGS. 1 through 11, the pickleball paddle assembly 10 generally comprises a head 12 that has a front side 14, a back side 16 and a perimeter edge 18. The perimeter edge 18 includes a top edge 20, a bottom edge 22, a first lateral edge 24 and a second lateral edge 26. A central portion or area of each of the front 14 and back 16 sides is planar and generally includes an area across an entire face of each of the front 14 and back 16 sides. The head 12 may be comprised of any conventional rigid, non-compressible material used for pickleball paddles such as wood, plastics, graphite composites and the like. A handle 28 is attached to and extends downwardly from the from the bottom edge 22 of the head 12. The handle 28 and head 12 form a paddle which can have any size common to pickleball paddles and which is governed by the rules of pickleball that typically require a total length of no greater than 17.0 inches and a combined length and width no greater than 24.0 inches.

The assembly 10 includes a plurality of inserts 30 and the perimeter edge 18 has a plurality of wells 32 extending therein. Each of the wells 32 is configured to releasably receive and retain one of the inserts 30 and the wells 32 will generally have a depth of less than 1.50 inches. Each insert 30 of the plurality of inserts 30 defines a weight such that a weight of the head 12 is selectively altered by inserting one or more of the inserts 30 into one or more of the wells 32. The inserts 30 may be made of any material that is practical for giving a desired weight component. As an example, this may include metals and their alloys, elastomers, plastics and the like. Particular metals/alloys which may be preferred include tungsten, steel, bronze, nickel, zinc, and titanium. The inserts 30 may be provided in different weights relative to each other either by adjusting their length or by utilizing different metals. For example, tungsten may be used for its relatively large density when a large amount of weight is required whereas titanium may be used when a much lighter weight is desired. Consequently, the inserts 30 may be provided in sets of different weights to be interchangeably used as needed.

The wells 32 are constructed to comprise a female mating member wherein the inserts 30 comprise a male mating member. In one example, the inserts 30 and wells 32 are each threaded to be threadably engaged with each other. The inserts 30 will have a fastener head 34 and the fastener head 34 can be made flush with an outer surface of the head 12 or may be countersunk into the head 12. The fastening head 12 may include receivers for engaging a tool to assist in the removal or insertion of the inserts 30 into a corresponding one of the wells 32. Alternatively, the inserts 30 may frictionally engage a wall of the well 32, though such a design may be less advantageous as inserts 30 may become dislodged when the assembly 10 is used to strike a ball.

The plurality of wells 32 will typically include at least three wells 32 and no more than sixteen wells 32, and more particularly at least eight wells 32. The top edge 20 may have three wells 30 positioned therein, spaced laterally from each other, and each of the first 24 and second 26 lateral edges have at least five wells 32 positioned therein vertically spaced from each other. In one embodiment, each of the first 24 and second 26 lateral edges includes an upper portion 36 having one of the wells 32 positioned therein, a lower portion 38 having one of the wells 32 positioned therein, and a central portion 40 having three of the wells 32 positioned therein.

In one embodiment of the assembly 10, the upper portion 36 is angled inwardly from the central portion 40 toward the top edge 20 and the lower portion 38 is angled inward from the central portion 40 toward the bottom edge 22. Additionally, the central portion 40 is angled outwardly from a center of the head 12 as the central portion 40 extends from the lower portion 38 to the upper portion 36. While the head 12 in the Figures generally shows angular bends in the first 24 and second 26 lateral edges, it should be understood that these may be rounded.

Figure 8:
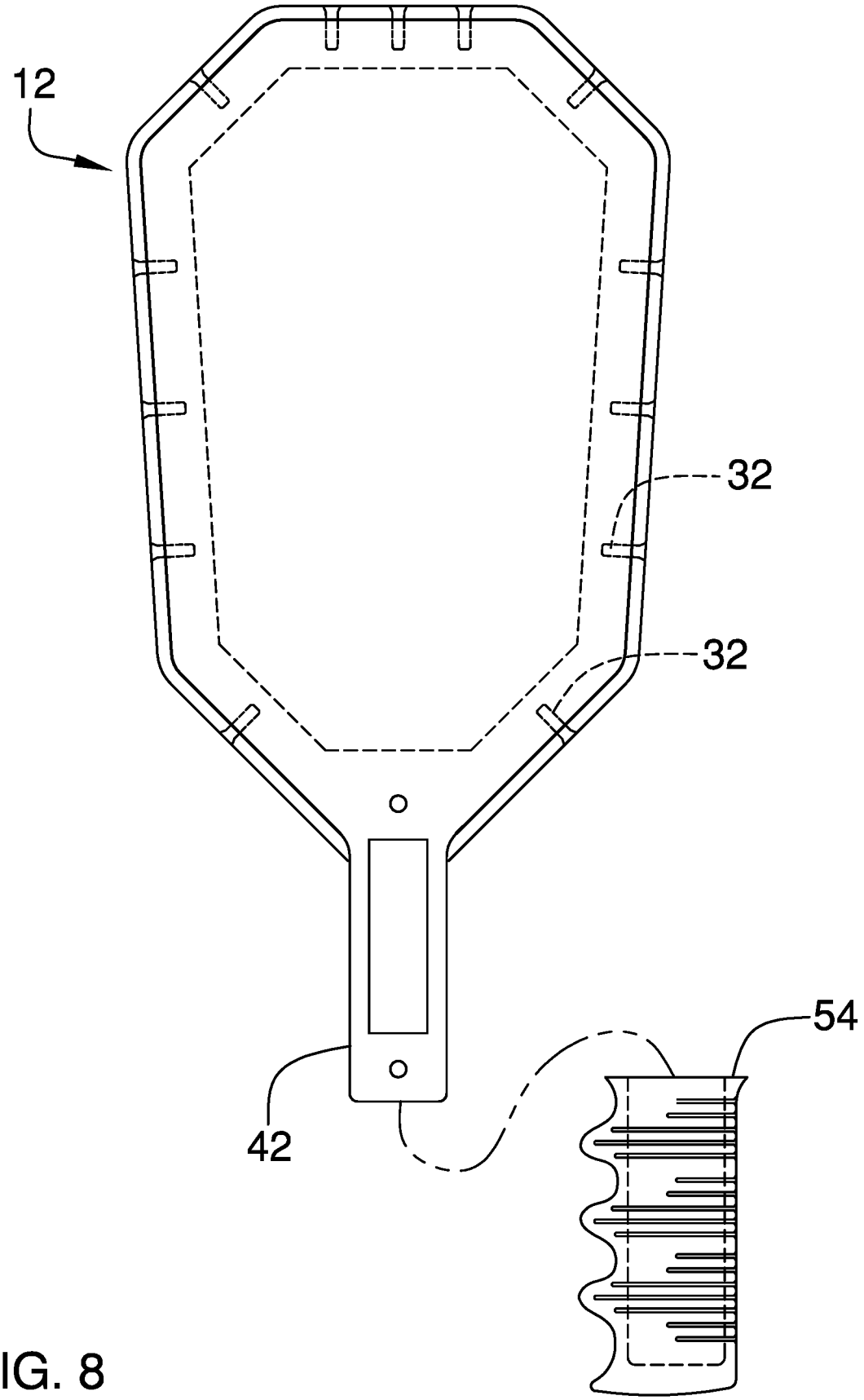
FIG. 8 is a front view of an embodiment of the disclosure.

While the handle 28 may comprise un-modifiable structure upon which may be positioned different wrappings, in some embodiments the handle 28 may comprise a central base 42, forming a core of the handle 28, which is attached to and forms a unitary structure with the bottom edge 22. The central base 42 has a first surface 44 corresponding to the first side 14 and a second surface 46 corresponding to the second side 16. Openings 48 may be positioned in the central base 42 extending through the first 44 and second 46 surfaces. A plurality of handle attachments 50 is removably attached to the first 44 and second 46 surfaces. For example, the handle attachments 50 may include a plurality of exterior grips 52. The exterior grips 52 are a portion of the handle 28 which is directly in contact with the hand of the user or is wrapped with conventional gripping tape. The exterior grips 52 may be swapped out for other exterior grips 52 to alter both the weight and overall feel of the handle 28. The exterior grips 52 may be comprised of different materials having varying compressibility as well as dissimilar tactile experiences. Some exterior grips 52 may be rough, while others are smooth and still others have uniform indents and detents as shown in FIG. 8. Also included may be a plurality of interior shims 54. The interior shims 54 are removably positionable between the exterior grips 52 and the central base 42. The interior shims 54 are configured to increase a weight and a circumference of the handle 28. Thus, the handle 28 is modifiable in nearly any desired weight, circumference and feel.

Figure 6:
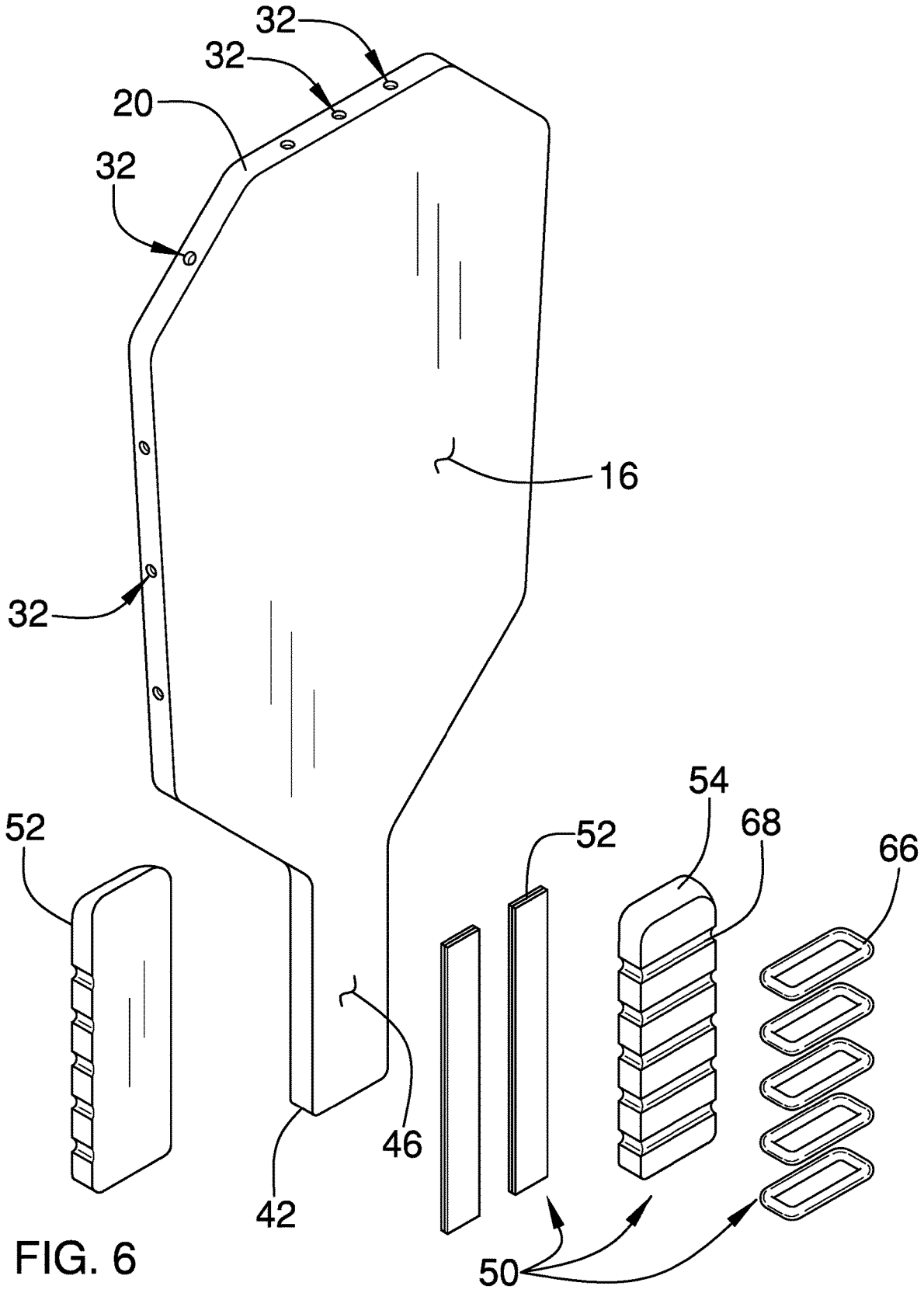
FIG. 6 is a rear isometric exploded view of an embodiment of the disclosure.
Figure 7:
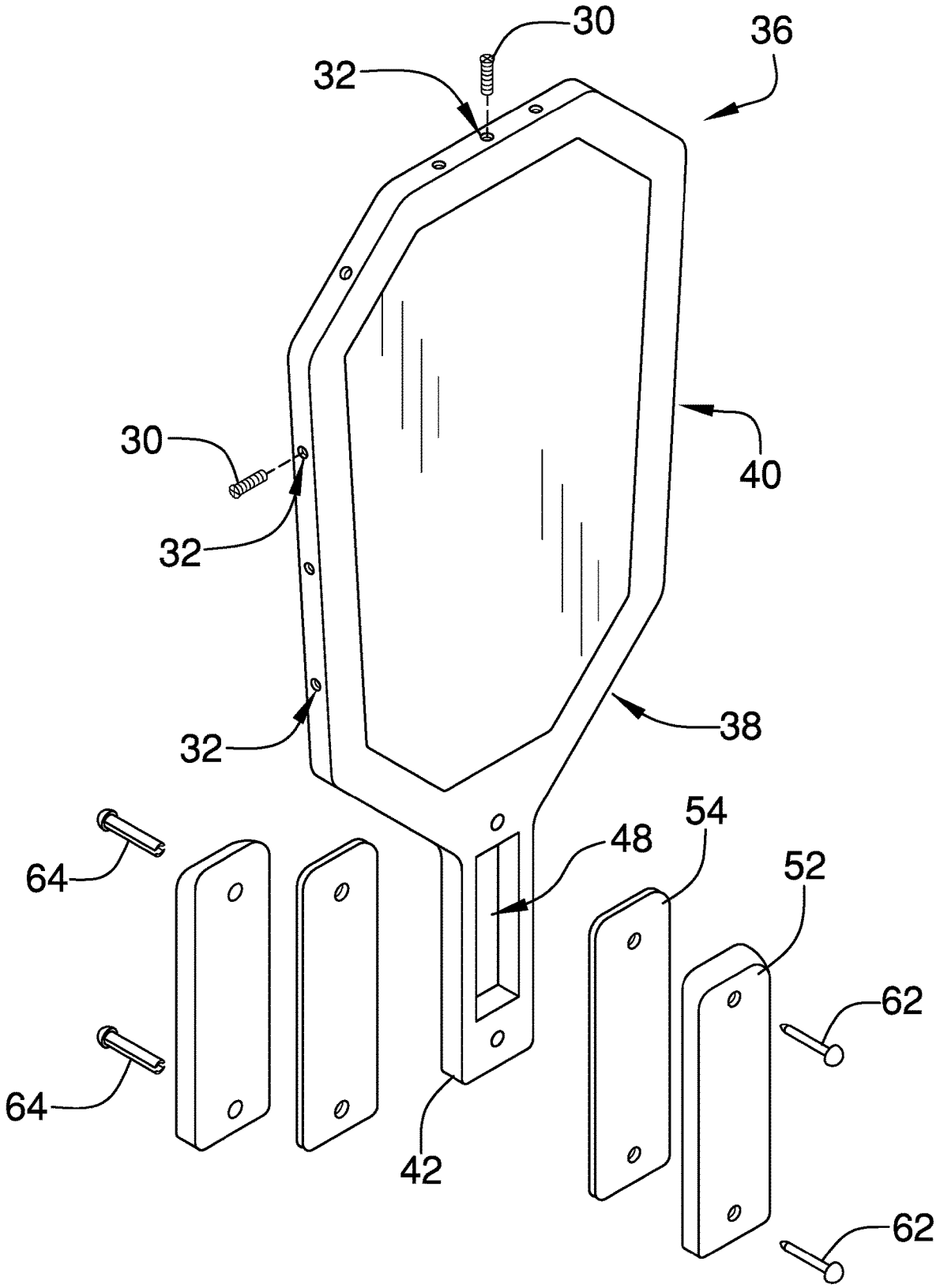
FIG. 7 is a rear isometric view of an embodiment of the disclosure.
Figure 9:
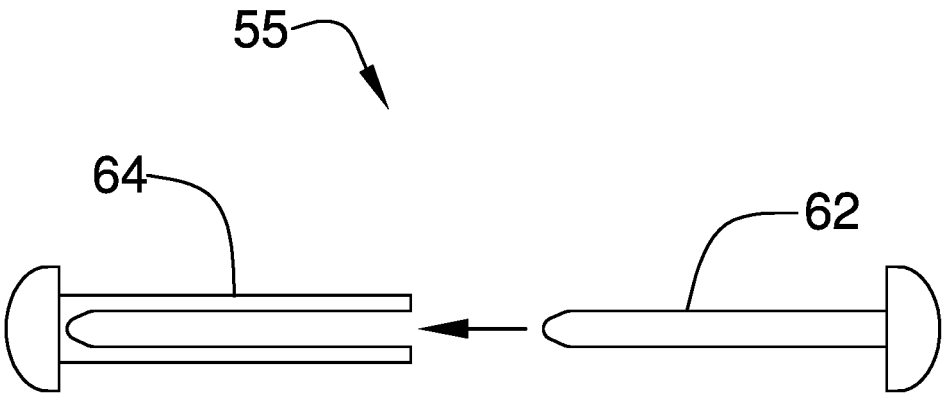
FIG. 9 is a front view of a fastener of an embodiment of the disclosure.

The handle attachments 50 may be secured to the central base 42 with any conventional mechanical fastener 55 such as conventional screws 56. As can be seen in the Figures, some embodiments include mating members 58, 60 attached to the central base 42 and exterior grips 50 which extend through interior shims 52. FIG. 9 shows a fastener that may be extended through all handle attachments 50 and through the central base 42 and comprises a pin 62 extendable into a receiver 64. FIG. 6 includes bands 66 positionable around the handle 28 and inserted into slots 68 in the exterior grips 54 while FIG. 2 uses bands 66 and tape 70. FIG. 8 shows an exterior grip 54 formed as a sleeve which is slid onto the central base 42. However, nearly all versions will be covered with gripping tape that may itself be varied and include versions resembling leather.

A border 72 may be attached to the perimeter edge 18 and extends along the top 20, first lateral 24 and second lateral 26 edges. The border 72 has a plurality of openings 74 extending therethrough and each of the wells 32 is aligned with one of the openings 74. The inserts 30 are extended through the openings 74 and may either be countersunk with respect to the border 72 or positioned flush with the border 72. The border 72 is comprised of a resiliently compressible material to protect the head 12 and other objects when the assembly 10 strikes another object.

Figure 10:
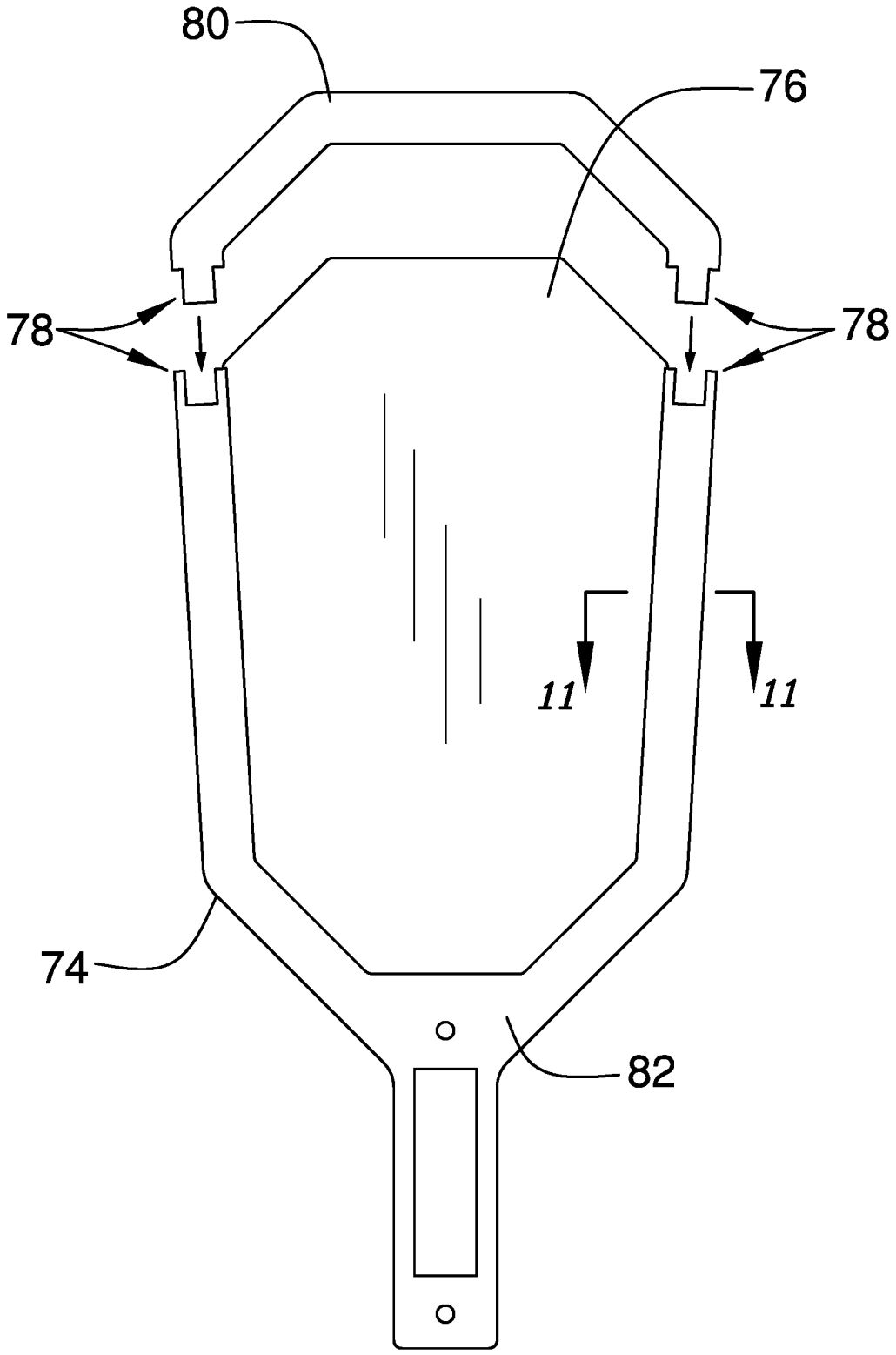
FIG. 10 is a front view of an embodiment of the disclosure.
Figure 11:
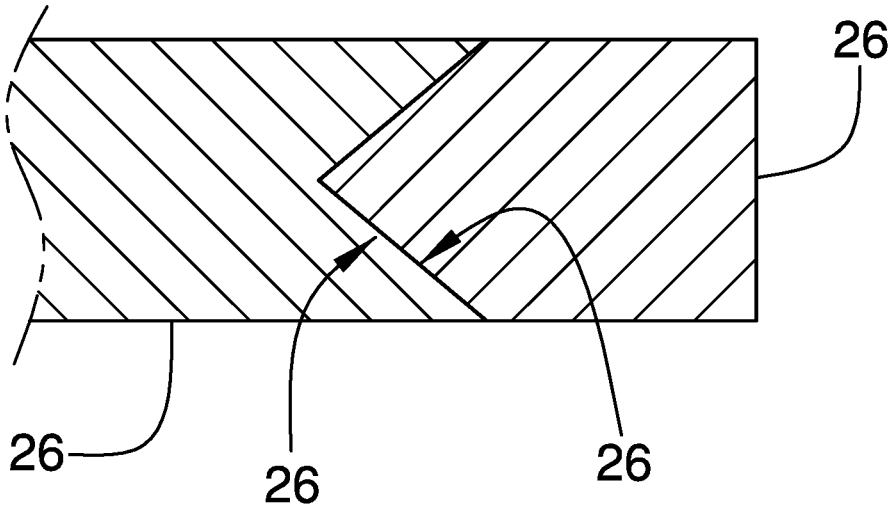
FIG. 11 is a cross-sectional view taken along line 11-11 of FIG. 10.

In an embodiment shown in FIGS. 10 and 11, the head 12 includes an outer receiving frame 74 and a removable plate 76. This allows the characteristics of the head 12 to be altered by changing, essentially, a face of the head 12. The front 14 and back 16 sides are therefore opposite sides of the removable plate 72. The first 24 and second 26 lateral edges each have a break 78 therein such that the outer receiving frame 74 includes a top section 80 including the top edge 20 and a bottom section 82 including the bottom edge 22. The top 80 and bottom 82 sections are releasably engaged with each other. This may be accomplished by having interlocking edges where the breaks 78 are positioned and which can be secured in place with a conventional mechanical fastening means such as a screw, pin, friction fitting or the like. The break 78 is positioned in a corresponding one of the central portions 40 and may be located nearer to the upper portions 36 than the lower portions 38. The outer receiving frame 74 has an interior edge 84 that extends into a receiving channel 86 of the removable plate 76. The removable plate 76 is slid onto the interior edge 84 of the bottom section 82 and then the top section 80 positioned on the removable plate 76 and joined to the bottom section 82. The removable plate 76 will be one of a plurality of removable plates 76 having different qualities such as feel and weight that may be based on materials and thickness. Thus the removable plates 76 may be comprised of wood, graphite composites, plastics or even metal. The removable plate 76 together with the outer receiving frame 74 forms a closed face of the head 12. This embodiment may, or may not, include the inserts 30 for weight adjustments.

In use, the assembly 10 is utilized in a conventional manner while playing pickleball. However, the weight and center of gravity of the assembly 10 may be altered by the utilization of the inserts 30. Additionally, the handle 28 may be modified as desired for weight, feel and circumference to tailor the gripping of the handle 28 specifically to the user of the assembly 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A game paddle assembly configured for use while playing pickleball, the assembly comprising: a head having a front side, a back side and a perimeter edge, the perimeter edge including a top edge, a bottom edge, a first lateral edge and a second lateral edge, a central portion of each of the front and back sides being planar; a handle being attached to and extending downwardly from the bottom edge of the head; a plurality of inserts; the perimeter edge having a plurality of wells extending therein, each of the wells being configured to releasably receive and retain one of the inserts; and each insert of the plurality of inserts defining a weight such that a weight of the head is selectively altered by inserting one or more of the inserts into one or more of the wells; and wherein the head includes an outer receiving frame and a removable plate, wherein the first and second lateral edges are positioned on the removable plate, the first and second lateral edges each having a break therein such that the outer receiving frame includes a top section including the top edge and a bottom section including the bottom edge, the top and bottom sections being releasably engaged with each other, the break being positioned at a central position of said first and second lateral edges, the outer receiving frame having an interior edge having a receiving channel therein for receiving the removable plate, wherein the removable plate and outer reeving frame form a closed face of the head.

2. The game paddle assembly according to claim 1, wherein each of the wells has a depth of less than 1.50 inches.

3. The game paddle assembly according to claim 1, wherein the plurality of wells includes at least three wells and no more than sixteen wells.

4. The game paddle assembly according to claim 1, wherein the top edge has three wells positioned therein and spaced laterally from each other.

5. The game paddle assembly according to claim 4, wherein each of the first and second lateral edges has five wells positioned therein.

6. The game paddle assembly according to claim 5, wherein each of the first and second lateral edges includes:

an upper portion, the upper portion having one of the wells positioned therein;

a lower portion, the lower portion having one of the wells positioned therein;

a central portion, the central portion having three of the wells positioned therein and being vertically spaced from each other;

wherein the upper portion is angled inwardly from the central portion toward the top edge and the lower portion is angled inward from the central portion toward the bottom edge, the central portion being angled outwardly from a center of the head as the central portion extends from the lower portion to the upper portion.

7. The game paddle assembly according to claim 1, wherein the handle comprises:

a central base being attached to and forming a unitary structure with the bottom edge, the central base having a first surface corresponding to the first lateral edge and a second surface corresponding to the second lateral edge; and a plurality of handle attachments being removably attached to the first and second surfaces.

8. The game paddle assembly according to claim 7, wherein the handle attachments include a plurality of exterior grips.

9. The game paddle assembly according to claim 8, wherein the handle attachments further include a plurality of interior shims, the interior shims being removably positionable between the exterior grips and the central base, the interior shims being configured to increase a weight and a circumference of the handle.

10. The game paddle assembly according to claim 1, further including a border being attached to the perimeter edge and extending along the top, first lateral and second lateral edges, the border having a plurality of openings extending therethrough, each of the wells being aligned with one of the openings, the border being comprised of a resiliently compressible material.

11. The game paddle assembly according to claim 7, further including a border being attached to the perimeter edge and extending along the top, first lateral and second lateral edges, the border having a plurality of openings extending therethrough, each of the wells being aligned with one of the openings, the border being comprised of a resiliently compressible material.

12. A game paddle assembly configured for use while playing pickleball, the assembly comprising:

a head having a front side, a back side and a perimeter edge, the perimeter edge including a top edge, a bottom edge, a first lateral edge and a second lateral edge, a central portion of each of the front and back sides being planar;

a handle being attached to and extending downwardly from the from the bottom edge of the head; and the head including an outer receiving frame and a removable plate, wherein the first and second lateral edges are positioned on the removable plate, the first and second lateral edges each having a break therein such that the outer receiving frame includes a top section including the top edge and a bottom section including the bottom edge, the top and bottom sections being releasably engaged with each other, the outer receiving frame having an interior edge having a receiving channel therein for receiving the removable plate, wherein the removable plate and outer receiving frame form a closed face of the head.

13. The game paddle assembly according to claim 12, further including:

a plurality of inserts;

the perimeter edge having a plurality of wells extending therein, each of the wells being configured to releaseably receive and retain one of the inserts; and each insert of the plurality of inserts defining a weight such that a weight of the head is selectively altered by inserting one or more of the inserts into one or more of the wells.

14. The game paddle assembly according to claim 13, wherein the handle comprises:

a central base being attached to and forming a unitary structure with the bottom edge, the central base having a first surface corresponding to the first lateral edge and a second surface corresponding to the second lateral edge; and a plurality of handle attachments being removably attached to the first and second surfaces.

15. The game paddle assembly according to claim 14, wherein the handle attachments includes:

a plurality of exterior grips; and a plurality of interior shims, the interior shims being removably positionable between the exterior grips and the central base, the interior shims being configured to increase a weight and a circumference of the handle.

16. The game paddle assembly according to claim 12, wherein the handle comprises:

a central base being attached to and forming a unitary structure with the bottom edge, the central base having a first surface corresponding to the first lateral edge and a second surface corresponding to the second lateral edge; and a plurality of handle attachments being removably attached to the first and second surfaces.

17. The game paddle assembly according to claim 16, wherein the handle attachments includes:

a plurality of exterior grips; and a plurality of interior shims, the interior shims being removably positionable between the exterior grips and the central base, the interior shims being configured to increase a weight and a circumference of the handle.

18. A game paddle assembly configured for use while playing pickleball, the assembly comprising: a head having a front side, a back side and a perimeter edge, the perimeter edge including a top edge, a bottom edge, a first lateral edge and a second lateral edge, a central portion of each of the front and back sides being planar; a handle being attached to and extending downwardly from the bottom edge of the head; a plurality of inserts; the perimeter edge having a plurality of wells extending therein, each of the wells being configured to releasably receive and retain one of the inserts, each of the wells having a depth of less than 1.50 inches; each insert of the plurality of inserts defining a weight such that a weight of the head is selectively altered by inserting one or more of the inserts into one or more of the wells; the plurality of wells including at least eight wells and no more than sixteen wells, the top edge having three wells positioned therein and spaced laterally from each other, each of the first and second lateral edges having at least five wells positioned therein; each of the first and second lateral edges including: an upper portion, the upper portion having one of the wells positioned therein; a lower portion, the lower portion having one of the wells positioned therein; a central portion, the central portion having three of the wells positioned therein and being vertically spaced from each other; wherein the upper portion is angled inwardly from the central portion toward the top edge and the lower portion is angled inward from the central portion toward the bottom edge, the central portion being angled outwardly from a center of the head as the central portion extends from the lower portion to the upper portion; the handle comprising: a central base being attached to and forming a unitary structure with the bottom edge, the central base having a first surface corresponding to the first lateral edge and a second surface corresponding to the second lateral edge; a plurality of handle attachments being removably attached to the first and second surfaces, the handle attachments including: a plurality of exterior grips; a plurality of interior shims, the interior shims being removably positionable between the exterior grips and the central base, the interior shims being configured to increase a weight and a circumference of the handle; a border being attached to the perimeter edge and extending along the top, first lateral and second lateral edges, the border having a plurality of openings extending therethrough, each of the wells being aligned with one of the openings, the border being comprised of a resiliently compressible material; and wherein the head including an outer receiving frame and a removable plate, wherein the first and second lateral edges are positioned on the removable plate, the first and second lateral edges each having a break therein such that the outer receiving frame includes a top section including the top edge and a bottom section including the bottom edge, the top and bottom sections being releasably engaged with each other, the break being positioned at a central position of said first and second lateral edges, the outer receiving frame having an interior edge having a receiving channel therein for receiving the removable plate, wherein the removable plate and outer receiving frame form a closed face of the head.

* * * * *